United States Patent [19]

Tominaga

[11] Patent Number: 4,694,521

[45] **Date of Patent: * Sep. 22, 1987**

[54] HUMAN BODY SUPPORTING DEVICE

[75] Inventor: Hiroshi Tominaga, Kanagawa, Japan

[73] Assignee: Fuji Electric Co., Ltd, Kanagawa, Japan

[ * ] Notice: The portion of the term of this patent subsequent to Jul. 15, 2003 has been disclaimed.

[21] Appl. No.: 876,111

[22] Filed: Jun. 19, 1986

[30] Foreign Application Priority Data

Jun. 19, 1985 [JP] Japan ..... 60-133739

[51] Int. Cl.[4] ..... A61G 7/00; A47C 27/08

[52] U.S. Cl. ..... 5/453; 5/469

[58] Field of Search ..... 5/453, 454, 449, 450, 5/469, 423; 128/38, 33

[56] References Cited

U.S. PATENT DOCUMENTS

| | | | |
|---|---|---|---|
| 3,644,950 | 2/1972 | Lindsay | 5/469 |
| 3,760,800 | 9/1973 | Staffin et al. | 128/38 |
| 4,483,029 | 4/1984 | Paul | 5/453 |
| 4,599,755 | 7/1986 | Tominaga | 5/453 |

*Primary Examiner*—Alexander Grosz

*Attorney, Agent, or Firm*—Finnegan, Henderson, Farabow, Garrett and Dunner

[57] ABSTRACT

A device for supporting a human body includes a mat having an upper layer of porous elastic material with fine particles mixed therein and a lower layer of porous elastic material. Air is blown through the mat from the lower layer, through the upper layer, and is discharged through an air permeable sheet covering the upper surface of the upper layer.

6 Claims, 4 Drawing Figures

HUMAN BODY SUPPORTING DEVICE

FIELD OF THE INVENTION

This invention relates to a human body supporting device such as a wheel-chair seat or a bed mattress which protects a human body from "bed sores" even though the human body is supported thereon for a long period of time.

BACKGROUND OF THE INVENTION

One example of a human body supporting device intended to prevent bed sores utilizes a suspension of fine particles in air. The device has the disadvantage, however, that it is too heavy to handle, too intricate in construction, and too high in manufacturing cost.

OBJECT AND SUMMARY OF THE INVENTION

An object of the present invention is a human body supporting device that is relatively simple in construction.

Another object of the present invention is a human body supporting device that has a low manufacturing cost.

The foregoing and other objects of the present invention are achieved by a human body supporting device comprising a human body supporting mat divided into an upper layer of porous elastic material in which fine particles are mixed and a lower layer of porous elastic mateiral, and a means for blowing air through the mat from the lower layer towards the upper layer.

A further object of the present invention is a human body supporting device that is portable and light weight.

Still another object of the present invention is a human body supporting device that can support a body for a long period of time without causing bed sores.

In such a human body supporting device, the porous elastic material is preferably a foamed material, the sides of the upper and lower layers are surrounded by a sheet that is not porous, the upper surface of the upper layer is covered by a porous sheet, and an air inlet is provided on the lower surface of the lower layer.

BRIEF DESCRIPTION OF THE DRAWINGS

The manner by which the above objects and other objects, features, and advantages of the present invention are attained will become fully apparent from the following detailed description when it is considered in view of the drawings, wherein.

DETAILED DESCRIPTION OF THE PREFERRED EMBODIMENTS

Figure 1:
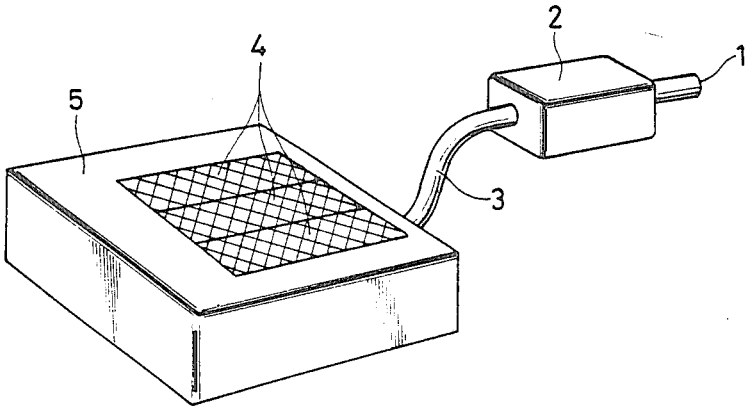
FIG. 1 is a perspective view of an embodiment of the human body supporting device of the present invention.

FIG. 1 is a perspective view of a human body supporting device according to the present invention. Air taken in through an air inlet 1 is delivered into a duct 3 by an air blower 2, and is discharged through the upper surface of a human body supporting device 4. A mat 5 is used to prevent the deformation of the human body supporting device 4, to decrease the air discharge area, and to decrease the weight of the human body supporting device 4.

Figure 2:
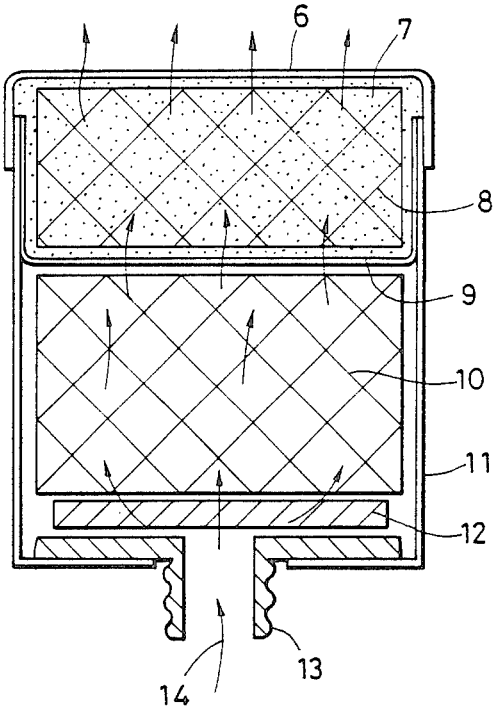
FIG. 2 is a sectional view of the human body supporting device of the present invention.

FIG. 2 is a sectional view of the human body supporting device 4 according to the present invention. In FIG. 2, a top sheet 6 has a number of holes about 15$\mu$ in diameter with a hole density of about 50% of the surface area. The top sheet 6 is low in ventilation resistance, but scarecely passes liquids such as water. Furthermore, the top sheet 6 receives the human body. A middle sheet 9 includes a plurality of holes about 2$\mu$ in diameter with a hole density of about 50% of the surface area. The middle sheet 9 has a ventilation pressure loss of about 200 mm. Thus, the middle sheet 9 is soft and serves as a diffusion board for uniformly delivering air into a mat 8.

A side sheet 11 is not porous, and is made, for instance, of vinyl leather, and mats 8 and 10 are made of porous elastic material such as foamed urethane. Fine particles 7, such as glass beads, acrylic resin beads, or hollow glass beads having a diameter of 100$\mu$, for example, are dispersed within mat 8. A metal net 12 is provided below mat 10 and board 13 and an air inlet 14 is disposed below the metal net 12.

In the human body supporting device thus constructed, pressuring air is delivered by the air blower and passes through the air inlet 14, the metal net 12, the mat 10 and the middle sheet 9 to fluidize the fine particles 7 in the mat 8. The air eventually passes through the top sheet 6 and is discharged into the atmosphere as it contacts a part of the human body. The air passing around and over the human body causes the body surface to be dried. Furthermore, the fluidized layer of fine particles causes the contact pressure to be uniform and improves the circulation of the blood. In addition, the fine particles may be slightly alkaline which further constributes to the prevention of bed sores.

Figure 3:
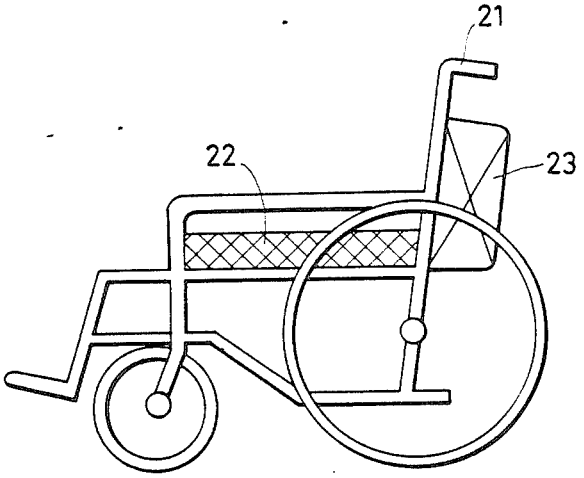
FIG. 3 is a front view of a wheelchair that incorporates the features of the human body supporting device of the present invention.

FIG. 3 shows the human body supporting device of the present invention applied to a wheelchair. In other words, the human body supporting device 22 of the present invention is mounted on the wheelchair 21, and air of suitable controlled temperature and a humidity is supplied under pressure by an air conditioner 23 to the human body supporting device. The human body supporting device of the present invention is applicable not only to wheelchairs, but also seats in airplanes, in automobiles, and in large halls.

Figure 4:
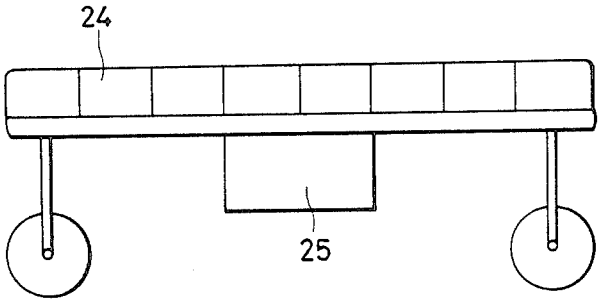
FIG. 4 is a front view of a bed that incorporates the features of the human body supporting device of the present invention.

FIG. 4 shows the human body supporting device 24 of the present invention applied to a bed. In FIG. 4, an air blower 25 supplies pressurized air to the device 24. The human body supporting device of the present invention may also be employed as a splint for treating a broken bone or as a supporter for a dislocated joint.

According to the present invention, the mat is divided into the upper and lower portions, and the fine particles are mixed in the upper part only. Therefore, the human body supporting device of the present invention is light in weight, simple in construction, and low in manufacturing cost.

It should be understood that the present invention is not limited to the particular embodiment and used described above, but rather is susceptible to modification, alterations, and equivalent arrangements within the scope of the appended claims.

What is claimed is:

1. A human body supporting device comprising:

a mat for receiving the body, the mat including an upper layer of porous elastic material having fine particles mixed therein and a lower layer of porous elastic material; and means for blowing air through said mat from said lower layer to said upper layer such that the blowing air suspends said particles in said upper layer.

2. A human body supporting device according to claim 1, wherein said porous elastic material is a foamed material.

3. A human body supporting device according to claim 2, wherein said foamed material is urethane.

4. A human body supporting device according to claim 1, wherein said upper and lower layers of said mat include sides covered with air impermeable material.

5. A human body supporting device according to claim 1, wherein said upper layer of said mat includes a top surface covered by an air permeable sheet.

6. A human body supporting device according to claim 1, wherein said lower layer of said mat includes a lower surface having an air inlet for receiving air from said blowing means.

* * * * *